US006213152B1

(12) United States Patent
Ayastuy

(10) Patent No.: US 6,213,152 B1
(45) Date of Patent: Apr. 10, 2001

(54) SAFETY GAS VALVE ARRANGEMENT FOR A COOKING HOB

(75) Inventor: Inaki Ayastuy, Caserio Gaztelu-Altos Hornos (ES)

(73) Assignee: Fagor, S. Coop., Mondragon (ES)

( * ) Notice: Subject to any disclaimer, the term of this patent is extended or adjusted under 35 U.S.C. 154(b) by 0 days.

(21) Appl. No.: 09/535,862

(22) Filed: Mar. 27, 2000

(30) Foreign Application Priority Data

Apr. 8, 1999 (ES) ..... 9900708

(51) Int. Cl.[7] ..... F16K 11/10
(52) U.S. Cl. ..... 137/883; 137/66
(58) Field of Search ..... 137/883, 66

(56) References Cited

U.S. PATENT DOCUMENTS 1,775,980 * 9/1930 Walbridge ..... 137/883
4,491,142 * 1/1985 Shimizu ..... 137/65
5,094,259 * 3/1992 Hsu ..... 137/66

* cited by examiner

*Primary Examiner*—John Fox
(74) *Attorney, Agent, or Firm*—The Kline Law Firm

(57) ABSTRACT

Safety gas valve arrangement on a cooking hob provided with a main gas supply rail (5), a set of various burners and the same number of manually regulated taps (3) provided with a rotatory regulating spindle **(3*a*) and an outlet duct (3*b*), the safety valve arrangement comprises a machined unitary valve body (2) with a inlet duct (23) and an outlet duct (24), intercalated and coupled to a tap (3) and to a rigid burner pipe (4), a cut-off valve (6,7) having an electromagnet assembly (6) operated by DC voltage, a housing (20) and a valve hole (7) which are communicated with said ducts (23,24). The dimensions (L, P-A) of the valve body (2) measured from the tap spindle (3*a*) are less than 50 mm to the pipe (4)** and 30 mm to the adjacent tap.

5 Claims, 1 Drawing Sheet

SAFETY GAS VALVE ARRANGEMENT FOR A COOKING HOB

The present invention relates to the installation and configuration of a burner combustion safety valve on a gas cooking hob, as well as to the body of the safety valve operated by electromagnet.

PRIOR ART

Cooking hob gas taps manually regulated by means of a rotary control having no flame safety valve are already known. A second type of tap for gas cookers has a built-in thermoelectric safety valve, which has to be reset initially for ignition by pressing the tap regulation shaft by hand until the flame detector thermocouple generates an e.m.f. to keep the valve open. This latter tap body is more complex because the safety valve housing has a shape and position interrelated with the shaft thrust mechanism.

On cooking hobs already installed that do not have a safety valve, the addition of a safety device is required without replacement of the manual tap. These taps are installed in line in the appliance on a rigid gas supply rail with a separation distance of 50 mm between the tap spindles. An individual rigid pipe runs from each pipe to a burner.

EP-790467 shows a safety valve for protecting a gas cooking hob, which cuts off the main gas supply to the cooker in case of gas leakage or a fault in the cooking hob, and is installed away from the appliance between the gas source and a flex hose supplying gas to the appliance.

DE-3818859 shows a safety device, which is a shut-off valve with two coaxial gas supply ducts, and between them two valve seats operated by the respective stem of a control device, mounted transversely to the two ducts.

DISCLOSURE OF THE INVENTION

The object of the invention is a safety gas valve arrangement for a cooking hob, provided with a valve body intercalated in the appliance between a manual regulating tap and the respective burner gas pipe, as defined in the claims.

The safety valve arrangement according to the invention provides a safety solution against the absence of a flame for cooking hobs currently in operation, wherein the present taps only incorporate a manually turned taper valve sealing member. The body of the safety valve does not require replacement of the rigid burner pipes as it is connected between the manual tap and the burner, occupying the free space already existing in the cooking hob. It also provides a solution for the installation of new cooking hobs, with no need for a tap with a built-in safety valve and manual resetting, as the safety valve according to the invention is operated by an electromagnet assembly, the winding of which is supplied from a DC voltage source. The safety valve electromagnet assembly maintains the size of the miniature thermoelectric magnet assembly that is usually fitted to safety valves operated by means of manual pressure.

DETAILED DESCRIPTION OF THE INVENTION

Figure 1:
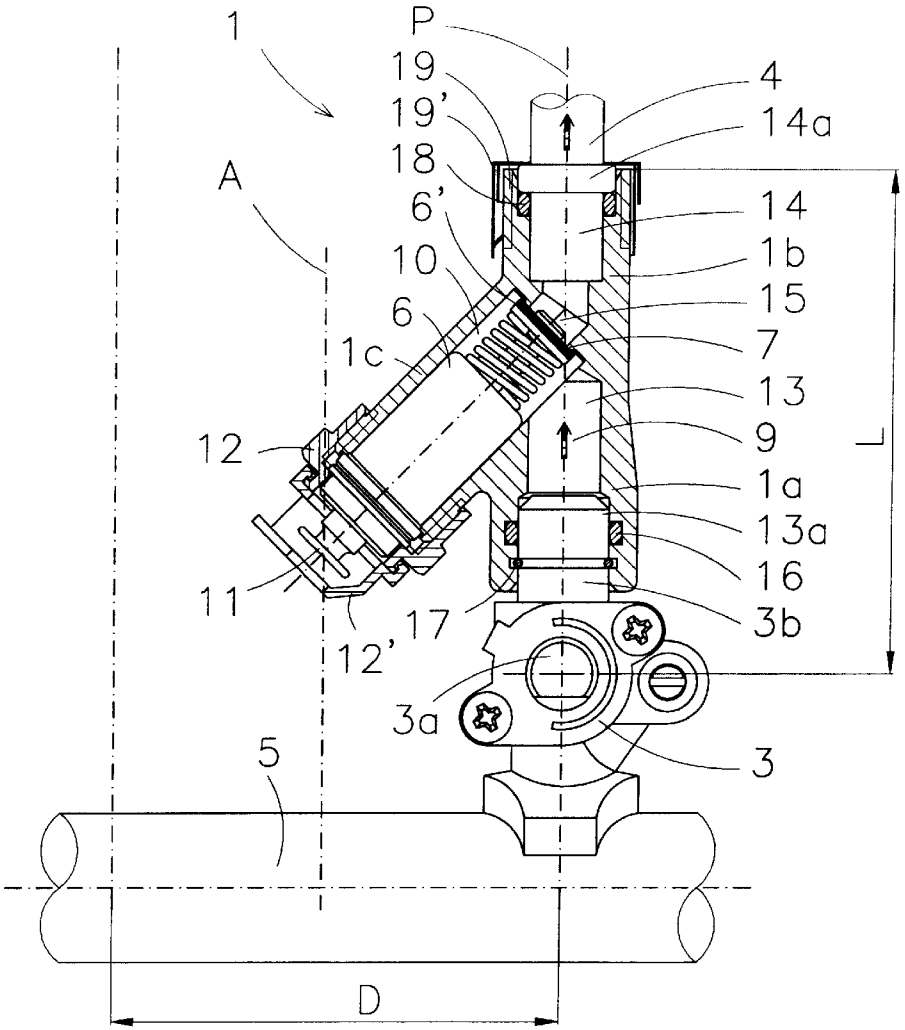
FIG. 1 is a sectional view of an embodiment of a valve arrangement installed on a cooking hob, according to the invention.
Figure 2:
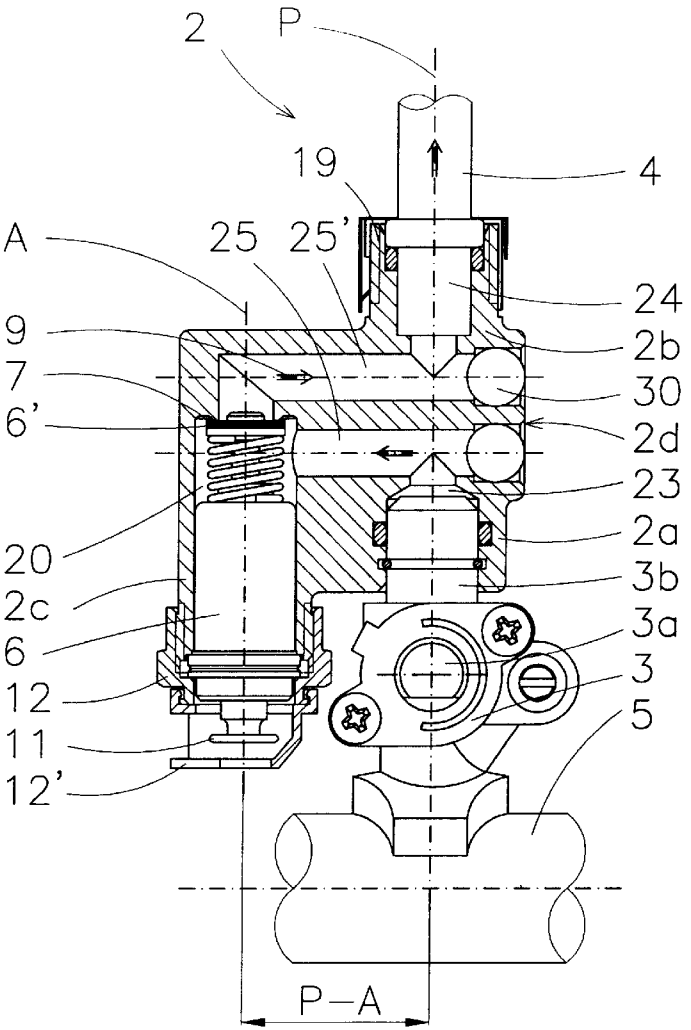
FIG. 2 is a sectional view of a second embodiment of a valve arrangement according to the invention.

In reference to FIGS. 1 and 2, they respectively show a safety valve arrangement according to the invention, on a cooking hob, by means of two different embodiments 1, 2 of the valve body, which houses a safety cut-off valve 6,7 and also comprises means for coupling the valve body 1,2 to a manual tap 3 on the cooking hob and to a rigid burner pipe 4. The valve body 1,2 is preferably made of brass, by means of pressing, although it may also be produced by means of a cut part made of extruded aluminium profile. The valve body 1,2 is intercalated between the manual regulating tap 3 and the pipe 4, letting the gas flow pass when the cut-off valve 6,7 is opened by means of wholly electrical action. The manual tap 3 is attached to a main hob gas supply rail 5, and has a rotary regulating spindle 3*a* oriented perpendicular relative to the gas rail 5, and a tap outlet 3*h* oriented at right angle to the rotary spindle 3*a*. The safety valve comprises an electromagnet assembly 6 provided with a valve seal member 6', which retracts when supplied with DC voltage, thereby opening the valve seat or hole 7 belonging to the body 1,2. The traction on the seal member 6' exerted by the electromagnet assembly 6 overcomes the resistance of the valve closing spring and establishes the flow of gas 9 towards the pipe 4. The cut-off valve 6,7 has a voltage connector 11 that protrudes to the exterior from the free end of a housing portion 1*c*–2*c* of the valve body, and is connected here by means of a lock nut 12 for airtight sealing and an outer insulating bush 12', in a known way.

The distribution on the hob main gas supply rail 5 of a series of taps 3 is conditioned by a distance D between their spindles 3*a* of 50 mm, leaving a very small separating space between them. An electric connection lead (not shown in the drawing) also has to be run in this space for attachment to the electromagnet assembly connector 11. Also due to the proximity of some burners, the length L of the valve body 1,2 has to be limited, in order to comply with the requisite of a maximum distance of 50 mm, from the connection to the pipe 4 to the tap spindle 3*a*.

In reference to FIG. 1, the embodiment 1 of valve body comprises a gas ducting straight cylindrical part 1*a*, 1*b*, the two ends of which are connected respectively to the tap 3 and to the pipe 4, and a cylindrical part 1*c* housing the electromagnet assembly 6, integral with the body 1, which intersects with said duct of the straight part 1*a*, 1*h* of the body. The electromagnet assembly housing is a duct 10 that is interposed between the tap 3 and the pipe 4, so that the gas flow 9 has to pass necessarily by way of the valve 6,7. The end 1*a* of the body for the gas inlet is machined with a blind hole 13 or duct, into which the tap outlet pipe 3*b* is inserted. The other end 1*b* of the body is the gas outlet, into which the burner pipe 4 is inserted. Both ducts 13, 14 are coaxial so as not to interfere with each other. The cylindrical part 1*a*, 1*b* of the body is constructed with a perpendicular orientation to the hob gas rail 5 and its length is limited by said maximum permissible length L. In order to limit the width of the body 1, while complying with said maximum distance condition D, the body part 1*c* for housing the electromagnet assembly 6 is oriented with an angle of inclination in respect of the straight part 1*a*, 1*b*. The housing 10 of the cut-off valve 6,7 intersects directly with the gas inlet duct 13, whilst to communicate with the outlet duct 14, the valve seat and hole 7 is extended with a duct 15 in the same direction as the electromagnet assembly housing duct 10.

For the airtight connection of the body 1 to the tap outlet pipe 3*b*, the end 1*a* of the body is machined with a connection port 13*a*, which is provided internally with two annular grooves 16 and 17 that receive a sealing ring and a pipe retaining washer 3*b*, respectively. For the airtight attachment of the burner pipe 4, the end 1*b* of the body is machined with a connection port 14*a*, which is fitted with an inner sealing ring 18, an outer threaded bushing 19, and a cylindrical retaining flange 19', which engages between the threads of the bushing 19.

In reference to FIG. 2, the valve body 2 comprises a thick central portion 2*a* attached directly to the tap 3, an outlet portion 2*b* protruding from the central portion 2*a* and oriented towards the burner, and a portion 2*c* protruding laterally from the central portion 2*a* and parallel to the protruding outlet portion 2*b*, but oriented in direction towards the gas rail 5. In the central portion 2*a* of the valve body a gas inlet hole or duct 23 is machined, into which the tap outlet pipe 3*b* is fitted, and also are machined two holes or ducts 25,25' communicating with the cut-off valve 6,7. In the valve body portion 2*h* for the gas outlet a hole or duct 24 is machined, into which the burner pipe 4 is inserted. The safety valve gas inlet and outlet ducts 23 and 24 are coaxial to each other and coplanar with the tap spindle 3*a*, in accordance with a common plane P. In the lateral body portion 2*c*, a cavity 20 is machined for housing the electromagnet assembly 6, at the end of which a lock nut 12 and an insulating bushing 12' are fitted, the same as in the embodiment of body 1 in FIG. 1. In order to limit the space occupied by the valve body 2 in width D, the electromagnet assembly 6 housing portion 2*c* is conformed with its axis A parallel to said plane P common with the tap spindle 3*a*, the separation distance P-A between them being approximately 25 mm.

The ducts 25, 25' communicating the gas flow 9 with the housing duct 20, are parallel to each other and are drilled from a lateral face 2*d* of the valve body in a perpendicular direction to said common plane P, until reaching respectively either one side or the other of the valve seat 7. The openings in the body 2, resulting from the drilled ducts 25, 25', are closed by means of tight sealing balls 30, engaged there. The gas inlet 23 and gas outlet 24 ducts in the body are drilled as far as the intersection with the respective communicating duct 25, 25'.

What is claimed is:

1. A safety gas valve arrangement for a cooking hob with a gas supply rail and a plurality of gas burners, each one supplied by a respective manually regulating tap provided with a rotary spindle oriented perpendicular to the gas rail, and the taps being arranged at a predetermined distance to each other, the safety gas valve comprising, a safety valve body intercalated between a burner and a manually regulating tap connected to the gas rail, and having an inlet and an oulet ducts machined coaxially in a respective body portion, and being oriented perpendicular to the gas rail, and a body portion protruding laterally relative to said common plane, and having a housing duct which houses a flame failure safety cut-off valve, and communicates the circulation between both inlet and outlet ducts, an electromagnetic assembly operated by an electrical DC voltage, and a valve seat hole machined in the lateral housing portion, a voltage connector protruding from the exterior end of the lateral housing portion, for connecting the electromagnetic assembly to the voltage supply, means for airtight coupling of the valve inlet duct to the regulating tap and the outlet duct to a burner pipe.

2. The safety valve arrangement of claim 1, wherein the body portions are aligned with the tap outlet and the burner pipe on a common plane with the tap spindle, extending a length less than 50 mm from the tap spindle, and the free end of the valve body lateral portion extends as far as a distance of less than 30 mm from said common plane.

3. The safety valve arrangement of claim 1, wherein said valve body laterally protruding portion is inclined in respect of said coaxial inlet and outlet ducts, and the valve housing and a extension duct of the cut-off valve hole intersect directly each one with the respective inlet or outlet duct.

4. The safety valve arrangement of claim 1, wherein said valve body protruding portion is parallel to said inlet and outlet ducts, and the cut-off valve housing and the cut-off valve hole intersect each one with the respective inlet or outlet duct by way of a respective communication duct machined in a transverse direction to said common plane.

5. A safety gas valve arrangement for a cooking hob comprising:

a main gas supply rail, a plurality of burners provided with a rigid pipe, a plurality of manually regulated taps attached to said gas supply rail, said taps comprise a rotary regulating spindle oriented perpendicular to said gas supply rail, at least one valve body provided with an inlet duct and an outlet duct, a cut-off valve housing, a cut-off valve having an electromagnetic assembly, a valve hole, and electrical connection means, and means for coupling said valve body to gas conduction means of said cooking hob; wherein each said valve body is unitary to a corresponding burner, each said valve body is machined with coaxial inlet and outlet ducts, and said valve body is positioned in said cooking hob between one of said taps and a corresponding one of said rigid pipes associated with said corresponding burner, and each said valve body comprises a lateral body portion machined to accommodate a housing of a cut-off valve, said cut-off valve being in line with gas circulation between said coaxial inlet and outlet ducts.

* * * * *